US009163444B1

(12) United States Patent
Fontijn et al.

(10) Patent No.: US 9,163,444 B1
(45) Date of Patent: Oct. 20, 2015

(54) DEVICE FOR MITIGATING THE EFFECTS OF STRUCTURE DEFLECTION ON SLIDING DOORS AND WINDOWS

(71) Applicant: Goldbrecht Inc., Culver City, CA (US)

(72) Inventors: Marcel Fontijn, West Hollywood, CA (US); Jorg Mager, Los Angeles, CA (US)

(73) Assignee: GOLDBRECHT INC., Culver City, CA (US)

( * ) Notice: Subject to any disclaimer, the term of this patent is extended or adjusted under 35 U.S.C. 154(b) by 0 days.

(21) Appl. No.: 14/508,751

(22) Filed: Oct. 7, 2014

(51) Int. Cl.

| | |
|---|---|
| ***E06B 1/20*** | (2006.01) |
| ***E05D 15/06*** | (2006.01) |
| ***E04H 9/02*** | (2006.01) |
| ***E04B 1/98*** | (2006.01) |
| ***E06B 7/28*** | (2006.01) |
| ***E06B 3/46*** | (2006.01) |

(52) U.S. Cl.
CPC ..... *E05D 15/0621* (2013.01); *E04B 1/98* (2013.01); *E04B 1/985* (2013.01); *E04H 9/02* (2013.01); *E06B 3/46* (2013.01); *E06B 7/28* (2013.01)

(58) Field of Classification Search
CPC ..... E06B 3/00; E04B 2/74; E04B 2/82; E05D 15/0621; E04H 9/02
USPC ..... 52/167.4, 167.1, 207, 210, 204.1, 52/204.5, 217, 204.51, 204.56, 126.1, 52/126.4, 126.6, 126.3, 64; 49/409, 324, 49/125, 501, 504–505
See application file for complete search history.

(56) References Cited

U.S. PATENT DOCUMENTS

| | | | | |
|---|---|---|---|---|
| 4,897,889 | A * | 2/1990 | Baus | 4/607 |
| 5,125,203 | A * | 6/1992 | Daw | 52/241 |
| 5,644,877 | A * | 7/1997 | Wood | 52/241 |
| 6,079,169 | A * | 6/2000 | Ashworth | 52/217 |
| 6,415,565 | B1 * | 7/2002 | Sosa | 52/207 |
| 8,112,954 | B2 * | 2/2012 | Gosling et al. | 52/207 |
| 2006/0070318 | A1 * | 4/2006 | Chen et al. | 52/204.65 |
| 2010/0175336 | A1 * | 7/2010 | Sullivan | 52/173.1 |
| 2010/0205880 | A1 * | 8/2010 | Lin | 52/207 |
| 2011/0247281 | A1 * | 10/2011 | Pilz et al. | 52/173.1 |
| 2012/0066989 | A1 * | 3/2012 | Pilz et al. | 52/232 |
| 2013/0219815 | A1 * | 8/2013 | Pilz et al. | 52/232 |
| 2015/0013243 | A1 * | 1/2015 | Gosling | 52/126.3 |

* cited by examiner

*Primary Examiner* — Beth Stephan
(74) *Attorney, Agent, or Firm* — Sughrue Mion, PLLC

(57) ABSTRACT

A method and apparatus is provided for maintaining functionality of at least one sliding panel of a sliding unit when a building structure to which the device is attached is subject to upward or downward movement. The method includes attaching a fixed guiding portion to the building and locating a variable panel track inside the fixed guiding portion, the variable panel track allowing a specified range of vertical movement of the sliding unit inside the fixed guiding portion in order to compensate for vertical movement of the building structure such that the at least one sliding panel is retained within the fixed guiding portion during the specified range of vertical movement, where either the fixed guiding portion is a fixed header and the variable panel track is a variable header track or the fixed guiding portion is a fixed floor channel and the variable panel track is a variable floor track.

18 Claims, 4 Drawing Sheets

+
0
-
22
12
14
18
16
20
(C)
UPWARD DEFLECTION
(B)
DOWNWARD DEFLECTION
(A)
NO DEFLECTION

+
0
-
UPWARD DEFLECTION
DOWNWARD DEFLECTION
NO DEFLECTION
12
32
14
34
36
18
16
20

+
0
-
UPWARD DEFLECTION
DOWNWARD DEFLECTION
NO DEFLECTION
118
114
112
122

+
0
-
UPWARD DEFLECTION
DOWNWARD DEFLECTION
NO DEFLECTION
118
136
134
114
132
112

DEVICE FOR MITIGATING THE EFFECTS OF STRUCTURE DEFLECTION ON SLIDING DOORS AND WINDOWS

FIELD OF THE INVENTION

The present invention is related to sliding doors and windows, henceforth referred to as sliding units. More specifically, the invention is related to a method and device for ensuring that sliding units remain operable when parts of a surrounding building structure cause the horizontal frame members of a sliding unit to deflect up or down, for example as a result of static or live loads, or seismic events.

DESCRIPTION OF THE RELATED ART

Sliding units can be categorized into top-hung units and standing-type units. The sliding panels of top-hung units are suspended from a header track with a floor track, if any, only having a guiding function (but no load bearing function).

The sliding panels of standing-type units are supported on a floor track, usually on rollers, with the header track guiding the sliding panels at the top and ensuring that the panels do not fall out. The present invention is applicable to both top-hung and standing-type sliding units.

Sliding units can have one or more sliding panels. In the case of a sliding unit with more than one sliding panel, the sliding panels can either be operated independently or in sequence. The present invention is applicable to sliding units with any number of sliding panels and irrespective of whether the panels can be operated independently or in sequence. In this document, any reference to sliding panel or sliding panels includes the singular and the plural.

The proper function of a sliding unit relies on a defined and consistent height of the unit's frame in relation to the height of the unit's sliding panel. If a standing-type sliding unit's frame is too high, or if the sliding panel is too low, there is a risk that the sliding panel will fall out when it loses lateral support inside the header track. If, on the other hand, the unit's frame is too low, or the sliding panel is too high, there is a risk that the sliding panel will jam when the top of the sliding panel touches the inside top of the header track.

Similarly, if a top-hung sliding unit's frame is too high, or if the sliding panel is too low, there is a risk that the sliding panel loses lateral support inside the floor track (if any) or that an unacceptably large gap appears between the floor and the bottom of the sliding panel. If, on the other hand, the unit's frame is too low, or the sliding panel is too high, there is a risk that the sliding panel will jam when the bottom of the sliding panel touches the floor or inside bottom of the floor track (if any).

While the height of a unit's sliding panel does not change over time, there are events that can affect the height of a unit's frame after installation. Such events include deflection of ceilings and floors caused by live or structural loads introduced after installation, as well as seismic events such as earthquakes.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof, as well as the appended drawings.

In one aspect of the invention, a device is provided for maintaining functionality of at least one sliding panel of a sliding unit when a building structure to which the device is attached is subject to upward or downward movement. The device includes a fixed header attached to the building structure and a variable header track located inside the fixed header and configured to allow for a specified range of vertical movement inside the fixed header in order to compensate for vertical movement of the building structure such that the at least one sliding panel is retained within the sliding unit and remains operable during the specified range of vertical movement.

It is contemplated that the variable header track is manually adjustable at least upward or downward inside the fixed header to compensate for the vertical movement of the building structure.

It is contemplated that one or more compression springs are placed between the fixed header and the variable header track, the one or more compression springs configured to allow movement of the variable header track in response to forces generated by the at least one sliding panel such that the variable header track is retained within the fixed header.

It is contemplated that a sliding panel head extension is provided at a top of at least one of the sliding panels of a sliding unit, the sliding panel head extension configured to provide lateral support for the corresponding sliding panel when deflection of the fixed header increases the frame height of the corresponding sliding unit.

It is contemplated that the variable header track is further configured to automatically adjust at least upward or downward to compensate for the vertical movement of the building structure.

It is contemplated that one or more compression springs are placed between the fixed header and the variable header track, the one or more compression springs configured to allow movement of the variable header track in response to forces generated by the at least one sliding panel such that the variable header track is retained within the fixed header.

It is contemplated that a sliding panel extension is provided at a top of each of the at least one sliding unit, the sliding panel extension configured to provide lateral support for the corresponding sliding unit when deflection of the fixed header increases a frame height of the corresponding sliding unit.

In another aspect of the invention, a device is provided for maintaining functionality of at least one sliding panel of a sliding unit when a building structure to which the device is attached is subject to upward or downward movement. The device includes a fixed floor channel attached to the building structure and a variable floor track located inside the fixed floor channel and configured to allow for a specified range of vertical movement of the sliding unit inside the fixed floor channel in order to compensate for vertical movement of the building structure such that the at least one sliding panel is retained within the fixed floor channel during the specified range of vertical movement, It is contemplated that the variable floor track is adjustable at least upward or downward to compensate for the vertical movement of the building structure.

It is contemplated that the variable floor track is manually adjustable at least upward or downward to compensate for the vertical movement of the building structure.

It is contemplated that one or more compression springs are placed between the fixed floor channel and the variable floor track, the one or more compression springs configured to allow movement of the variable floor track in response to forces generated by the at least one sliding panel such that the variable floor track is retained within the fixed floor channel.

It is contemplated that a sliding panel extension is provided at a bottom of each of the at least one sliding unit, the sliding panel extension configured to provide lateral support for the corresponding sliding unit when deflection of the fixed floor channel increases a frame height of the corresponding sliding unit.

It is contemplated that the variable floor track is further configured to automatically adjust at least upward or downward to compensate for the vertical movement of the building structure.

It is contemplated that one or more compression springs are placed between the fixed floor channel and the variable floor track, the one or more compression springs configured to allow movement of the variable header track in response to forces generated by the at least one sliding panel such that the variable header track is retained within the fixed header.

It is contemplated that a sliding panel extension is provided at a bottom of each of the at least one sliding unit, the sliding panel extension configured to provide lateral support for the corresponding sliding unit when deflection of the fixed floor channel increases a frame height of the corresponding sliding unit.

In another aspect of the invention, a method is provided for maintaining functionality of at least one sliding panel of a sliding unit when a building structure to which the device is attached is subject to upward or downward movement. The method includes attaching a fixed guiding portion to the building and locating a variable panel track inside the fixed guiding portion, the variable panel track allowing a specified range of vertical movement of the sliding unit inside the fixed guiding portion in order to compensate for vertical movement of the building structure such that the at least one sliding panel is retained within the fixed guiding portion during the specified range of vertical movement, where either the fixed guiding portion is a fixed header and the variable panel track is a variable header track or the fixed guiding portion is a fixed floor channel and the variable panel track is a variable floor track.

It is contemplated that manually adjusting the variable panel track at least upward or downward compensates for the vertical movement of the building structure.

It is contemplated that one or more compression springs are placed between the fixed guiding portion and the variable panel track, the one or more compression springs configured to allow movement of the variable panel track in response to forces generated by the at least one sliding panel such that the variable panel track is retained within the fixed guiding portion.

It is contemplated that a sliding panel extension is attached to each of the at least one sliding unit, the sliding panel extension configured to provide lateral support for the corresponding sliding unit when deflection of the at least the variable panel track or the fixed guiding portion increases a frame height of the corresponding sliding unit.

It is contemplated that the variable panel track is automatically adjusted at least upward or downward to compensate for the vertical movement of the building structure.

It is contemplated that compression springs are placed between the fixed guiding portion and the variable panel track, the one or more compression springs configured to allow movement of the variable panel track in response to forces generated by the at least one sliding panel such that the variable panel track is retained within the fixed guiding portion.

Additional features and advantages of the invention will be set forth in the description which follows, and in part will be apparent from the description, or may be learned by practice of the invention. It is to be understood that both the foregoing general description and the following detailed description of the present invention are exemplary and explanatory and are intended to provide further explanation of the invention as claimed.

These and other embodiments will also become readily apparent to those skilled in the art from the following detailed description of the embodiments having reference to the attached figures, the invention not being limited to any particular embodiments disclosed.

BRIEF DESCRIPTION OF THE DRAWINGS

The accompanying drawings, which are included to provide a further understanding of the invention and are incorporated in, and constitute a part of, this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

Figures 1A, 1B, 1C:
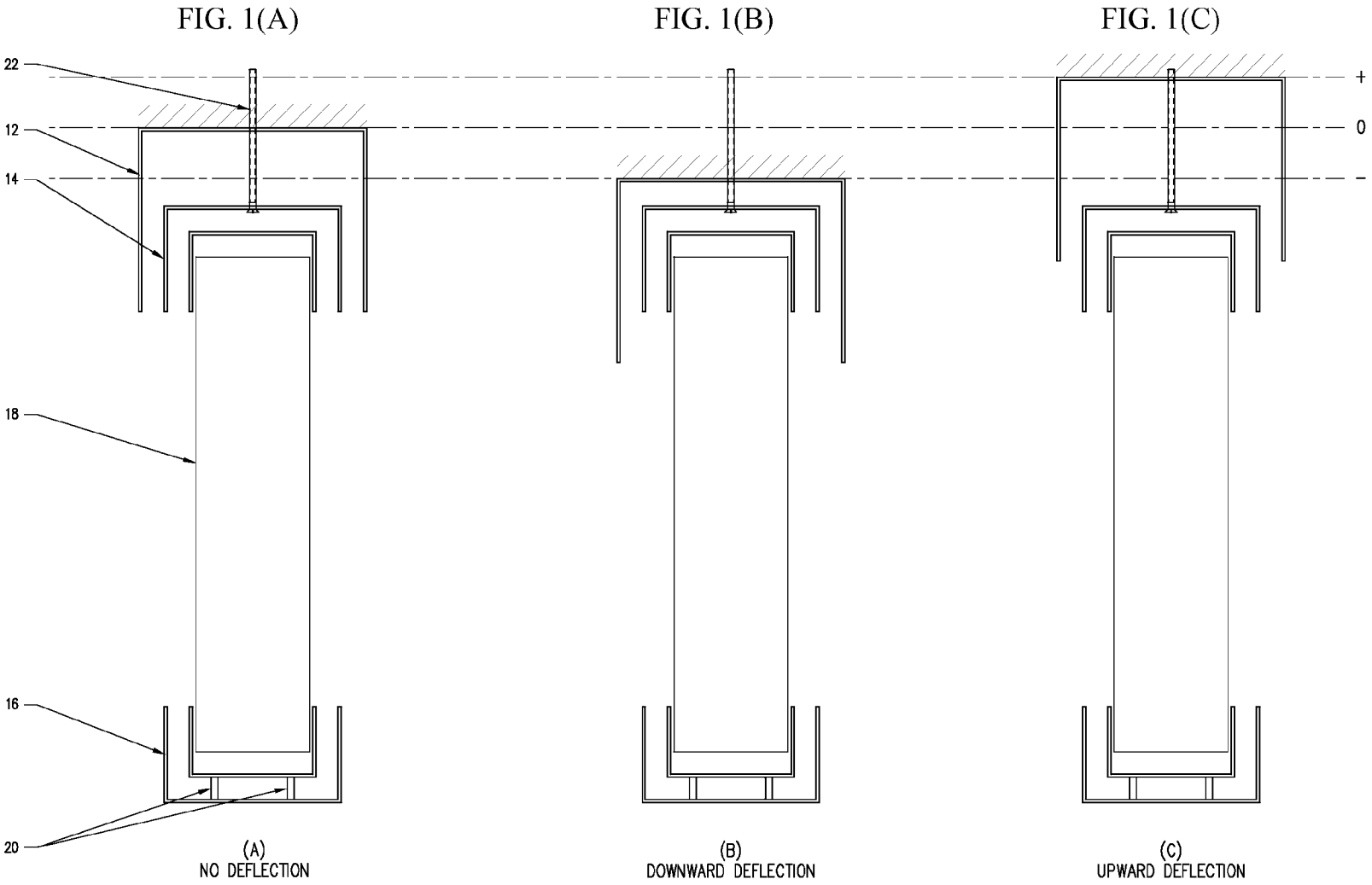
FIG. 1A is a schematic diagram illustrating main components of a first sliding unit to which the present invention is applicable, specifically a manually adjustable variable header track in a condition where there is no deflection caused by movement of the building structure in which the sliding unit is installed.
FIG. 1B is a schematic diagram illustrating the manually adjustable variable header track in FIG. 1A in a condition where there is downward deflection caused by movement of the building structure in which the sliding unit is installed.
FIG. 1C is a schematic diagram illustrating the manually adjustable variable header track in FIG. 1A in a condition where there is upward deflection caused by movement of the building structure in which the sliding unit is installed.

The present invention is related to a device that either fully or partially replaces the regular header track of a standing-type sliding unit, or fully or partially replaces any regular floor track of a top-hung sliding unit, in order to accommodate a specified degree of vertical movement of the building structure to which the device is attached. Within the specified degree of vertical movement, the sliding panels of a sliding unit fitted with the device according to the present invention will remain operable, either by manual or automatic adjustment of the device, to accommodate the vertical movement of the building structure.

With reference to FIGS. 1A-1C and FIGS. 2A-2C, main components of a device according to one embodiment of the present invention are:

A fixed header 12 attached to the building structure;

A variable header track 14 mounted inside the fixed header 12;

In the case of an automatically adjustable variable header track, one or more compression springs 32 placed between the fixed header 12 and the variable header track 14, and a sliding panel head extension 36 attached to the top of the sliding panel 18.

Because the fixed header 12 is attached to the building structure, it follows any upward or downward movement of the building structure. The variable header track 14 is either manually or automatically adjustable up and/or down in a vertical direction within the fixed header 12. The amount of vertical movement of the variable header track can be designed as required for a particular application.

Upward movement of the variable header track 14 is limited by the vertical space made available between the top of the variable header track and the inside top of the fixed header 12. Downward movement of the variable header track is limited by the vertical distance made available between the top of the variable header track and the bottom of the fixed header. The variable header track must be fitted inside of the fixed header such that it cannot fall out of the fixed header.

Manually Adjustable Variable Header Track

With reference to FIG. 1A, the design of a manually adjustable variable header track 14 according to the present invention incorporates a means for manually moving the variable header track upward and/or downward inside the fixed header 12, such as adjustment screws 22 placed at regular intervals. The manually adjustable variable header track works well to accommodate vertical movement of a corresponding building structure caused by static loads, e.g. defection as a result of loads introduced after installation of the sliding unit.

When downward deflection occurs, as illustrated in FIG. 1B, such as when the corresponding building structure forces the fixed header 12 downward, the variable header track 14 is manually adjusted upward inside the fixed header to provide the necessary clearance between the top of the sliding panel 18 and the variable header track such that the sliding panel moves freely.

When upward deflection occurs, as illustrated in FIG. 1C, such as when the corresponding building structure forces the fixed header 12 upward, the variable header track 14 is manually adjusted downward inside the fixed header to ensure continued lateral support of the top of the sliding panel 18 inside the variable header track.

Automatically Adjustable Variable Header Track

Figures 2A, 2B, 2C:
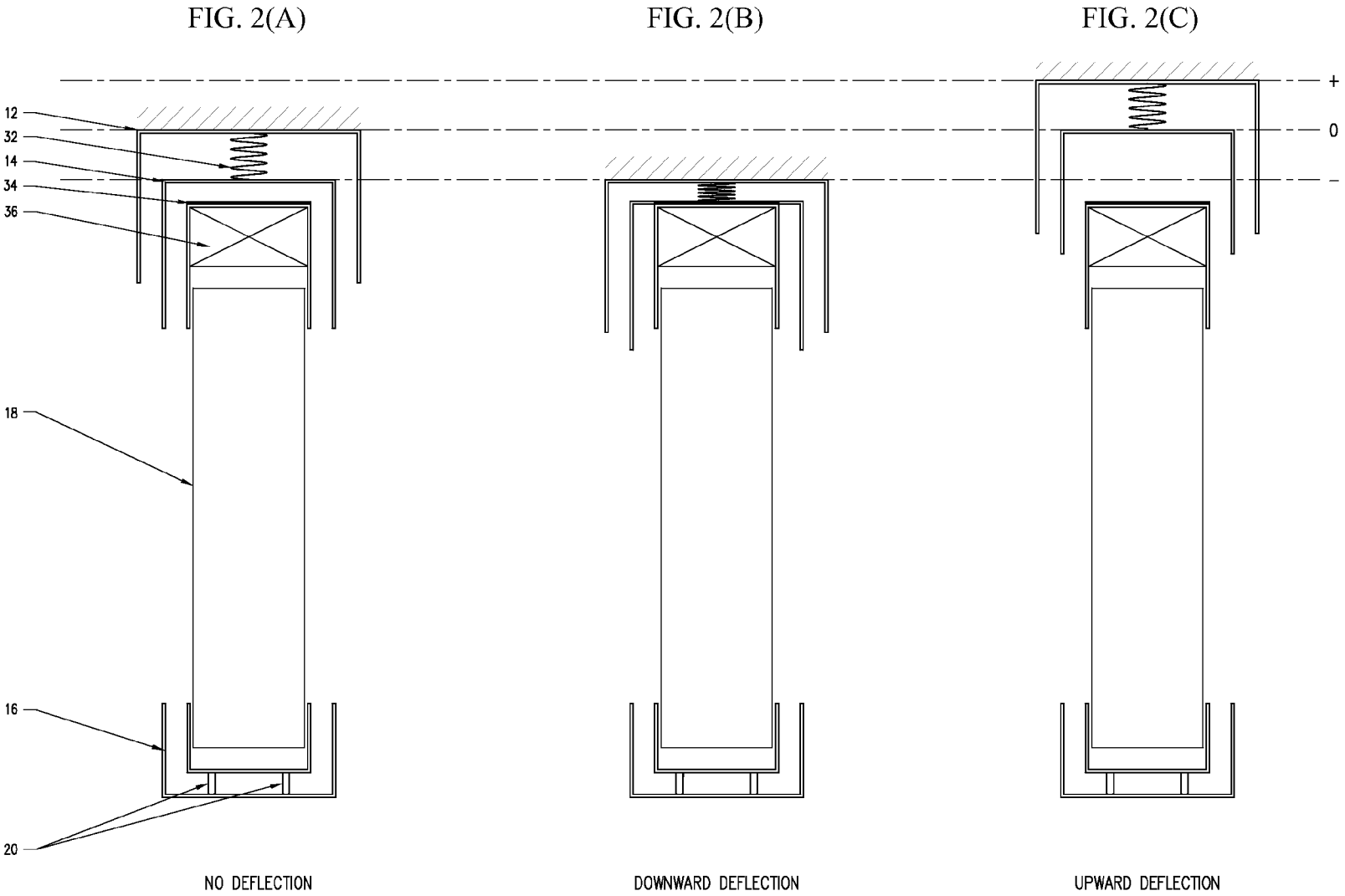
FIG. 2A is a schematic diagram illustrating main components of a second sliding unit to which the present invention is applicable, specifically an automatically adjustable variable header track in a condition where there is no deflection caused by movement of the building structure in which the sliding unit is installed.
FIG. 2B is a schematic diagram illustrating the automatically adjustable variable header track in FIG. 2A in a condition where there is downward deflection caused by movement of the building structure in which the sliding unit is installed.
FIG. 2C is a schematic diagram illustrating the automatically adjustable variable header track in FIG. 2A in a condition where there is upward deflection caused by movement of the building structure in which the sliding unit is installed.

With reference to FIG. 2A, the design of an automatically adjustable variable header track 14 according to the present invention allows the device to accommodate vertical movement of the corresponding building structure without manual intervention. The automatically adjustable variable header track can accommodate movements of the corresponding building structure caused by live loads and seismic events, in addition to accommodating movements of the corresponding building structure caused by static loads.

When downward deflection occurs, as illustrated in FIG. 2B, the variable header track 14 comes into contact with a sliding panel head extension 36 and the space between the top of the variable header track and the inside top of the fixed header 12 reduces as downward deflection of the fixed header increases.

Compression springs 32 placed between the fixed header 12 and the variable header track 14 help overcome friction caused by deformation and/or horizontal deflection of the variable header track and/or the fixed header and, in the case of seismic events, prevent the variable header track from jumping up during the event and the sliding panels from falling out.

Friction reducing material 34 attached to the top of the sliding panel head extension 36 can assist in reducing the effort required to move the sliding panel 18 against the weight of the variable header track resting on the sliding panel head extension and the additional load imposed on the sliding panel head extension by the compression springs 32.

When upward deflection occurs, as illustrated in FIG. 2C, the sliding panel head extension 36 mounted on top of the sliding panel 18 ensures that the sliding panel 18 does not lose lateral support inside the variable header track 14 when the building structure forces the fixed header 12 upward.

With reference to FIGS. 3A-3C and FIGS. 4A-4C, main components of a device according other embodiments of the present invention are:

A fixed floor channel 112 attached to the building structure;

A variable floor track 114 mounted inside the fixed floor channel 112;

In the case of an automatically adjustable variable floor track, one or more compression springs 132 placed between the fixed floor channel 112 and the variable floor track 114, and a sliding panel extension 136 attached to the bottom of the sliding panel 118.

Because the fixed floor channel 112 is attached to the building structure, it follows any upward or downward movement of the building structure. The variable floor track 114 is either manually or automatically adjustable up and/or down in a vertical direction within the fixed floor channel 112. The amount of vertical movement of the variable floor track can be designed as required for a particular application.

Downward movement of the variable floor track 114 is limited by the vertical space made available between the bottom of the variable floor track and the inside bottom of the fixed floor channel 112. Upward movement of the variable floor track is limited by the vertical distance made available between the bottom of the variable floor track and the top of the fixed floor channel. The variable floor track must be fitted inside of the fixed floor channel such that it cannot fall out of the fixed floor channel.

Manually Adjustable Variable Floor Track

Figures 3A, 3B, 3C:
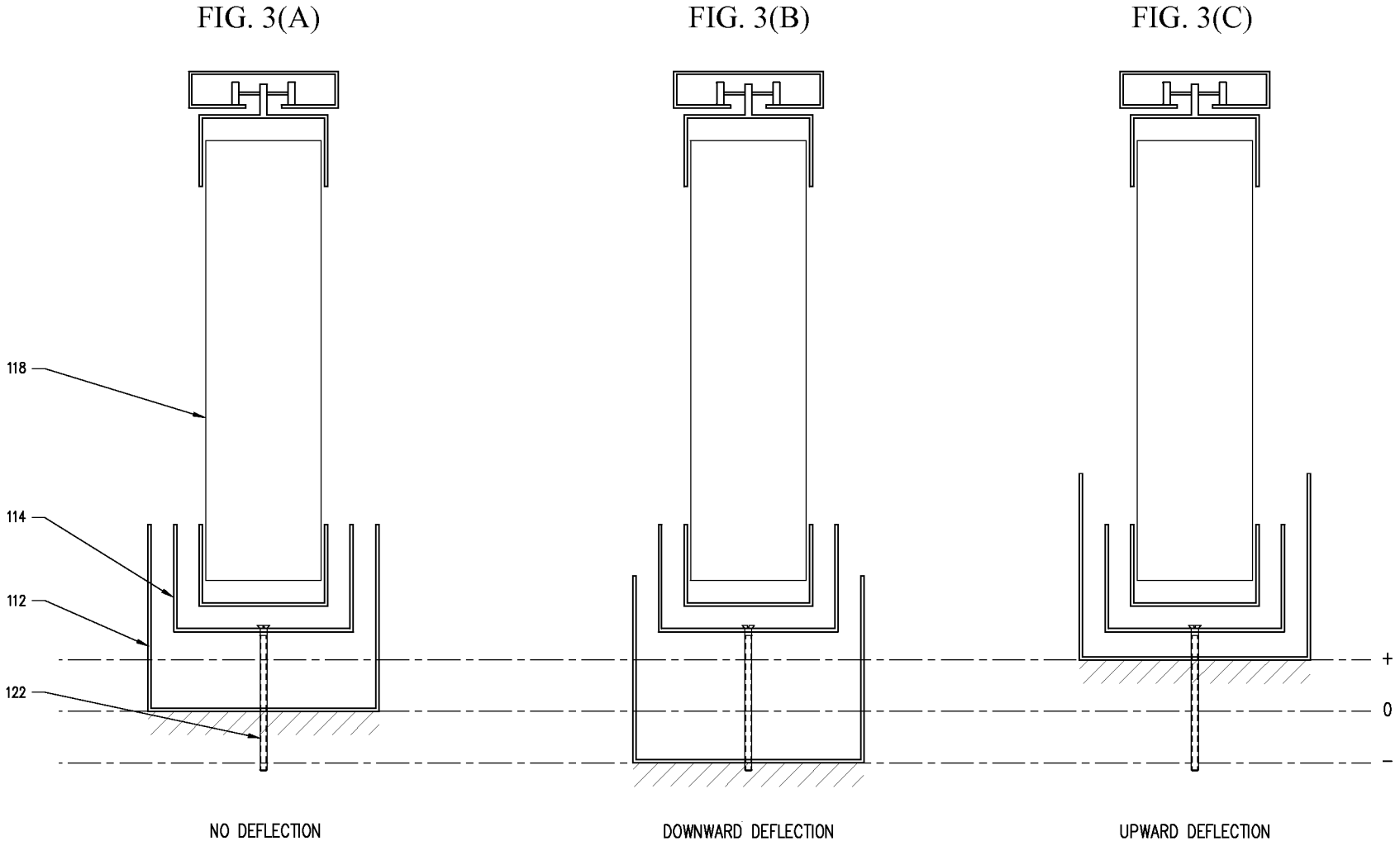
FIG. 3A is a schematic diagram illustrating main components of a third sliding unit to which the present invention is applicable, specifically a manually adjustable variable floor track in a condition where there is no deflection caused by movement of the building structure in which the sliding unit is installed.
FIG. 3B is a schematic diagram illustrating the manually adjustable variable floor track in FIG. 3A in a condition where there is downward deflection caused by movement of the building structure in which the sliding unit is installed.
FIG. 3C is a schematic diagram illustrating the manually adjustable variable floor track in FIG. 3A in a condition where there is upward deflection caused by movement of the building structure in which the sliding unit is installed.

With reference to FIG. 3A, the design of a manually adjustable variable floor track 114 according to the present invention incorporates a means for manually moving the variable floor track upward and/or downward inside the fixed floor channel 112, such as adjustment screws 122 placed at regular intervals. The manually adjustable variable floor track works well to accommodate vertical movement of a corresponding building structure caused by static loads, e.g. defection as a result of loads introduced after installation of the sliding unit.

When downward deflection occurs, as illustrated in FIG. 3B, such as when the corresponding building structure forces the fixed floor channel 112 downward, the variable floor track 114 is manually adjusted upward inside the fixed floor channel to ensure continued lateral support of the bottom of the sliding panel 118 inside the variable floor track.

When upward deflection occurs, as illustrated in FIG. 3C, such as when the corresponding building structure forces the fixed floor channel 112 upward, the variable floor track 114 is manually adjusted downward inside the fixed floor channel to provide the necessary clearance between the bottom of the sliding panel 118 and the variable floor track such that the sliding panel moves freely.

Automatically Adjustable Variable Floor Track

Figures 4A, 4B, 4C:
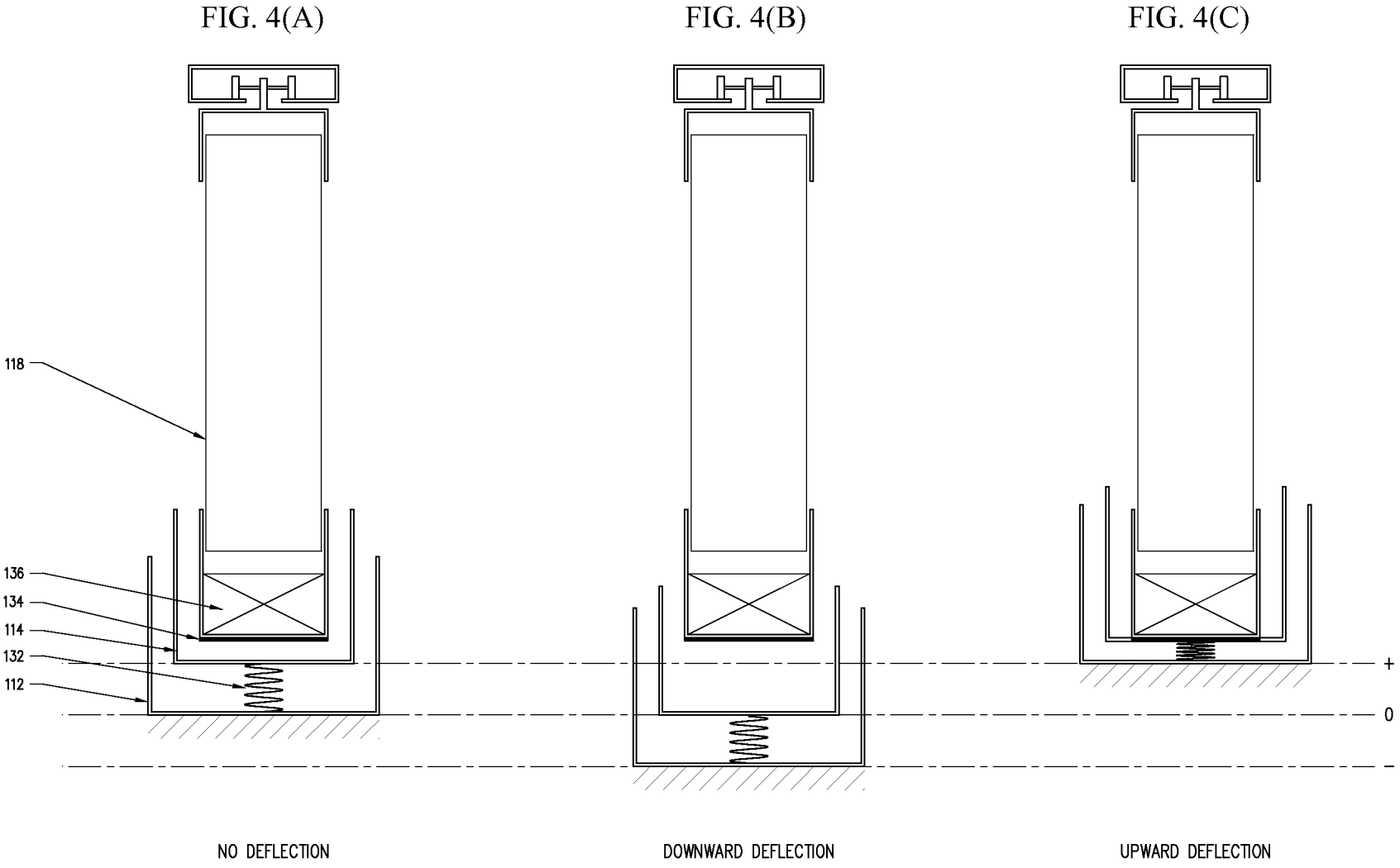
FIG. 4A is a schematic diagram illustrating main components of a fourth sliding unit to which the present invention is applicable, specifically an automatically adjustable variable floor track in a condition where there is no deflection caused by movement of the building structure in which the sliding unit is installed.
FIG. 4B is a schematic diagram illustrating the automatically adjustable variable floor track in FIG. 4A in a condition where there is downward deflection caused by movement of the building structure in which the sliding unit is installed.
FIG. 4C is a schematic diagram illustrating the automatically adjustable variable floor track in FIG. 4A in a condition where there is upward deflection caused by movement of the building structure in which the sliding unit is installed.

With reference to FIG. 4A, the design of an automatically adjustable variable floor track 114 according to the present invention allows the device to accommodate vertical movement of the corresponding building structure without manual intervention. The automatically adjustable variable floor track can accommodate movements of the corresponding building structure caused by live loads and seismic events, in addition to accommodating movements of the corresponding building structure caused by static loads.

When downward deflection occurs, as illustrated in FIG. 4B, the sliding panel extension 136 mounted at the bottom of the sliding panel 118 ensures that the sliding panel 18 does not lose lateral support inside the variable floor track 114 when the building structure forces the fixed floor channel 112 downward.

When upward deflection occurs, as illustrated in FIG. 4C, the variable floor track 114 comes into contact with a sliding panel extension 136 and the space between the bottom of the variable floor track and the inside bottom of the fixed floor channel 112 reduces as upward deflection of the fixed floor channel increases.

Compression springs 132 placed between the fixed floor channel 112 and the variable floor track 114 help overcome friction caused by deformation and/or horizontal deflection of the variable floor track and/or the fixed floor channel.

Friction reducing material 134 attached to the bottom of the sliding panel extension 136 can assist in reducing the effort required to move the sliding panel 118 against the load imposed on the sliding panel head extension by the compression springs 132.

It should be understood that the invention can be practiced with modification and alteration within the spirit and scope of the appended claims. The description is not intended to be exhaustive or to limit the invention to the precise form disclosed. These and various other adaptations and combinations of the embodiments disclosed are within the scope of the invention and are further defined by the claims and their full scope of equivalents.

As the present invention may be embodied in several forms without departing from the spirit or essential characteristics thereof, it should also be understood that the embodiments described herein are not limited by any of the details of their description, unless otherwise specified, but rather should be construed broadly within its spirit and scope as defined in the appended claims. Therefore, all changes and modifications that fall within the metes and bounds of the claims, or equivalence of such metes and bounds are intended to be embraced by the appended claims.

The embodiments and advantages described herein are merely exemplary and are not to be construed as limiting the present invention. The present teaching can be readily applied to other types of apparatuses.

The description of the present invention is intended to be illustrative, and not to limit the scope of the claims. Many alternatives, modifications, and variations will be apparent to those skilled in the art.

Therefore, it should be understood that the invention can be practiced with modification and alteration within the spirit and scope of the appended claims. The description is not intended to be exhaustive or to limit the invention to the precise form disclosed herein. These and various other adaptations and combinations of the embodiments disclosed herein are within the scope of the invention and are further defined by the claims and their full scope of equivalents.

What is claimed is:

1. A device for maintaining functionality of at least one sliding panel of a sliding unit when a building to which the device is attached is subject to upward or downward movement, the device comprising:

a fixed header attached to a building structure;

a variable header track located inside the fixed header and configured to allow for a specified range of vertical movement inside the fixed header in order to compensate for vertical movement of the building structure such that the at least one sliding panel is retained within the sliding unit and remains operable during the specified range of vertical movement, and at least one compression spring placed between the fixed header and the variable header track, the at least one compression spring configured to allow movement of the variable header track in response to forces generated by the at least one sliding panel such that the variable header track is retained within the fixed header.

2. The device according to claim 1, wherein the variable header track is manually adjustable at least upward or downward inside the fixed header to compensate for the vertical movement of the building structure.

3. The device according to claim 1, further comprising the at least one compression spring comprising a plurality of compression springs.

4. The device according to claim 2, further comprising a sliding panel head extension at a top of at least one of the sliding panels of a sliding unit, the sliding panel head extension configured to provide lateral support for the corresponding sliding panel when deflection of the fixed header increases a frame height of the corresponding sliding unit.

5. The device according to claim 1, wherein the variable header track is further configured to automatically adjust at least upward or downward to compensate for the vertical movement of the building structure.

6. The device according to claim 5, further comprising a sliding panel extension at a top of each of the at least one sliding unit, the sliding panel extension configured to provide lateral support for the corresponding sliding unit when deflection of the fixed header increases a frame height of the corresponding sliding unit.

7. A device for maintaining functionality of at least one sliding panel of a sliding unit when a building structure to which the device is attached is subject to upward or downward movement, the device comprising:

a fixed floor channel attached to a building structure;

a variable floor track located inside the fixed floor channel and configured to allow for a specified range of vertical movement of the sliding unit inside the fixed floor channel in order to compensate for vertical movement of the building structure such that the at least one sliding panel is retained within the fixed floor channel during the specified range of vertical movement, wherein the variable floor track is adjustable at least upward or downward to compensate for the vertical movement of the building structure, and at least one compression spring placed between the fixed header and the variable floor track, the at least one compression spring configured to allow movement of the variable floor track in response to forces generated by the at least one sliding panel such that the variable floor track is retained within the fixed header.

8. The device according to claim 7, wherein the variable floor track is manually adjustable at least upward or downward to compensate for the vertical movement of the building structure.

9. The device according to claim 7, further comprising the at least one compression spring comprising a plurality of compression springs.

10. The device according to claim 8, further comprising a sliding panel extension at a bottom of each of the at least one sliding unit, the sliding panel extension configured to provide lateral support for the corresponding sliding unit when deflection of the fixed floor channel increases a frame height of the corresponding sliding unit.

11. The device according to claim 7, wherein the variable floor track is further configured to automatically adjust at least upward or downward to compensate for the vertical movement of the building structure.

12. The device according to claim 11, further comprising a sliding panel extension at a bottom of each of the at least one sliding unit, the sliding panel extension configured to provide lateral support for the corresponding sliding unit when deflection of the fixed floor channel increases a frame height of the corresponding sliding unit.

13. A method for maintaining functionality of at least one sliding panel of a sliding unit when a building to which the device is attached is subject to upward or downward movement, the method comprising:

attaching a fixed guiding portion to a building structure;

locating a variable panel track inside the fixed guiding portion, the variable panel track allowing a specified range of vertical movement of the sliding unit inside the fixed guiding portion in order to compensate for vertical movement of the building structure such that the at least one sliding panel is retained within the fixed guiding portion during the specified range of vertical movement, wherein either the fixed guiding portion is a fixed header and the variable panel track is a variable header track or the fixed guiding portion is a fixed floor channel and the variable panel track is a variable floor track, and locating at least one compression spring between the fixed guiding portion and the variable panel track, the at least one compression spring configured to allow movement of the variable panel track in response to forces generated by the at least one sliding panel such that the variable panel track is retained within the fixed guiding portion.

14. The method according to claim 13, further comprising manually adjusting the variable panel track at least upward or downward to compensate for the vertical movement of the building structure.

15. The method according to claim 13, further comprising the at least one compression spring comprising a plurality of compression springs.

16. The method according to claim 13, further comprising attaching a sliding panel extension to each of the at least one sliding unit, the sliding panel extension configured to provide lateral support for the corresponding sliding unit when deflection of the at least the variable panel track or the fixed guiding portion increases a frame height of the corresponding sliding unit.

17. The method according to claim 13, further automatically adjusting the variable panel track at least upward or downward to compensate for the vertical movement of the building structure.

18. A device for maintaining functionality of at least one sliding panel of a sliding unit when a building to which the device is attached is subject to upward or downward movement, the device comprising:

a fixed channel attached to a building structure; and a variable track located inside the fixed channel and configured to allow for a specified range of vertical movement inside the fixed channel in order to compensate for vertical movement of the building structure such that the at least one sliding panel is retained within the sliding unit and remains operable during the specified range of vertical movement, an attachment mechanism located between the variable track and fixed channel such that the variable track automatically adjusts with respect to the fixed channel in response to forces generated on the at least one sliding panel to compensate for vertical movement of the building structure.

* * * * *